US008813829B2

(12) United States Patent
Ina et al.

(10) Patent No.: US 8,813,829 B2
(45) Date of Patent: Aug. 26, 2014

(54) METHOD FOR PRODUCING MOLD

(75) Inventors: Yoshimitsu Ina, Aichi (JP); Shigeo Nakai, Wakayama (JP); Toshiki Matsuo, Aichi (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 12/990,396

(22) PCT Filed: Apr. 27, 2009

(86) PCT No.: PCT/JP2009/058654
§ 371 (c)(1),
(2), (4) Date: Jan. 10, 2011

(87) PCT Pub. No.: WO2009/133959
PCT Pub. Date: Nov. 5, 2009

(65) Prior Publication Data

US 2011/0100578 A1 May 5, 2011

(30) Foreign Application Priority Data

Apr. 30, 2008 (JP) ..... 2008-118940

(51) Int. Cl.
*B22C 1/22* (2006.01)
*B22C 9/02* (2006.01)

(52) U.S. Cl.
USPC ..... 164/525; 106/38.27

(58) Field of Classification Search
USPC ..... 164/5, 16, 520–529; 106/38.2–38.9
See application file for complete search history.

(56) References Cited

U.S. PATENT DOCUMENTS

| | | | | |
|---|---|---|---|---|
| 2,478,461 | A * | 8/1949 | Connolly | 209/3 |
| 4,045,411 | A * | 8/1977 | Vasishth et al. | 525/505 |
| 4,436,138 | A * | 3/1984 | Kondo | 164/5 |
| 5,288,774 | A * | 2/1994 | Gardziella et al. | 524/74 |
| 5,491,180 | A * | 2/1996 | Kiuchi et al. | 523/139 |
| 5,516,859 | A * | 5/1996 | Dunnavant et al. | 525/504 |
| 6,326,418 | B1 | 12/2001 | Nakai et al. | |
| 2005/0017394 | A1 * | 1/2005 | Hochsmann et al. | 264/113 |
| 2008/0274374 | A1 | 11/2008 | Ina | |

FOREIGN PATENT DOCUMENTS

| | | | |
|---|---|---|---|
| CN | 1247487 | A | 3/2000 |
| CN | 1929937 | A | 3/2007 |
| JP | 2005-193267 | A | 7/2005 |
| JP | 2006-247716 | A | 9/2006 |

OTHER PUBLICATIONS

International Search Report for PCT/JP2009/058654 dated Jul. 7, 2009.

English translation of International Preliminary Report on Patentability (Form PCT/IB/373) and of Written Opinion of the International Searching Authority (Form PCT/ISA/237) issued on Dec. 13, 2010 in PCT/JP2009/058654.

Notification of the First Office Action for corresponding Chinese Patent Application No. 200980115284.6, dated Aug. 3, 2012.

* cited by examiner

*Primary Examiner* — Keith Walker
*Assistant Examiner* — Kevin E Yoon
(74) *Attorney, Agent, or Firm* — Birch, Stewart, Kolasch & Birch, LLP

(57) ABSTRACT

In production of a mold with the reclaimed spherical molding sand having a sphericity of 0.95 or more and mainly composed of $Al_2O_3$ together with the binder containing the acid-hardening resin and the hardening agent (I), at least one of the hardening agents (I) and (II) that is used in production of a mold from which the reclaimed molding sand is obtained contains the organic sulfonic acid, and in the hardening agent, a content of sulfuric acid is not more than 5% by weight and a content of phosphoric acid is not more than 5% by weight.

16 Claims, No Drawings

METHOD FOR PRODUCING MOLD

FIELD OF THE INVENTION

The present invention relates to a method for producing a mold with a reclaimed molding sand.

BACKGROUND OF THE INVENTION

Silica sand, zircon sand, chromite sand, olivine sand, and the like have been often used in a molding sand (refractory granular material) for forming a mold. To save shortcomings of these sands, recently, use of artificial molding sand has been studied. Examples of the artificial molding sand include those mainly composed of $Al_2O_3$ such as mullite-based and alumina-based molding sands. Such a molding sand has good properties such as high refractoriness, low heat-expandability, high crushing-resistance and being spherical. This has led to an increasing demand for it every year. In the field of forming a mold employing a furan self-hardening process with an acid-hardening furan resin, there have been increasing cases of trying to use it. A technique of using an acid-hardening resin in such a molding sand mainly composed of $Al_2O_3$, which has already been widely known, is known to have problems.

To solve a problem of decreased mold strength in cases of large and complicated molds formed with kneaded sand that is regulated to take a longtime to start hardening, or in the case of long bench life, JP-A 9-47840 discloses a composition for forming a mold containing a hardening agent containing phosphoric acid and organic sulfonic acid as essential components, where contents of phosphoric acid and organic sulfonic acid are 10 to 85% by weight and 5 to 70% by weight, respectively.

To reduce a content of sulfur atom in a mold, JP-A 2006-247716 discloses a method of producing a mold by adding a binder composition containing a furan resin and a hardening composition containing a sulfur atom and a phosphorus atom at a weight ratio of 0 to 0.7 represented by [sulfur atom content/(phosphorus atom content+sulfur atom content)] to 100 parts by weight of a spherical molding sand that is produced by a flame fusion method at a specific ratio, and hardening the furan resin.

JP-A 57-58948 describes a method of producing a furan mold with a reclaimed molding sand, in which p-toluenesulfonic acid or xylenesulfonic acid is used as a hardening catalyst for a furan resin containing nitrogen.

SUMMARY OF THE INVENTION

The present invention provides a method for producing a mold with a reclaimed molding sand, a binder (I) containing an acid-hardening resin and a hardening agent (I), wherein the reclaimed molding sand is mainly composed of $Al_2O_3$ and obtained from a mold produced with a spherical molding sand (A) having a sphericity of 0.95 or more, a binder (II) containing an acid-hardening resin and a hardening agent (II), and at least one of the hardening agents (I) and (II) contains an organic sulfonic acid, and in the hardening agent, a content of sulfuric acid is not more than 5% by weight and a content of phosphoric acid is not more than 5% by weight.

The present invention includes the method described above, wherein the hardening agent (II) contains the organic sulfonic acid, and in the hardening agent, a content of sulfuric acid is not more than 5% by weight and a content of phosphoric acid is not more than 5% by weight. That is, the present invention provides a method for producing a mold with a reclaimed molding sand, a binder (I) containing an acid-hardening resin and a hardening agent (I), wherein the reclaimed molding sand is mainly composed of $Al_2O_3$ and obtained from a mold produced with a spherical molding sand (A) having a sphericity of 0.95 or more, a binder (II) containing an acid-hardening resin and a hardening agent (II), and the hardening agent (II) contains the organic sulfonic acid, and in the hardening agent, a content of sulfuric acid is not more than 5% by weight and a content of phosphoric acid is not more than 5% by weight.

In other words, the method of producing a mold of the present invention includes producing a mold with a reclaimed molding sand, wherein the reclaimed molding sand is obtained from a mold produced with (1) a spherical molding sand having a sphericity of 0.95 or more and mainly composed of $Al_2O_3$, (2) a binder containing an acid-hardening resin, and (3) a hardening agent containing an organic sulfonic acid, in which a content of sulfuric acid is not more than 5% by weight and a content of phosphoric acid is not more than 5% by weight.

DETAILED DESCRIPTION OF THE INVENTION

A molding sand is used to form a mold and reclaimed from the mold after casting. Silica molding sand is preferably used, because a reclaimed silica molding sand repeatedly used with an acid-hardening binder, such as a furan binder, has a feature of faster hardening rate than a new sand.

However, molding sands, particularly a spherical molding sand mainly composed of $Al_2O_3$ have a problem of decreased hardening rate in forming a mold when a reclaimed molding sand after used with an acid-hardening binder is hardened again with an acid-hardening resin. The problem becomes conspicuous in cases of a strong reclaiming treatment for controlling a residual resin in a reclaimed molding sand to a small amount and a low sand/metal ratio, which is a weight ratio of a mold to a casting article [mold/molten metal (weight ratio)]. Artificial ceramic molding sand produced by a flame fusion method, an atomizing method, and the like has high sphericity and smooth surface by itself can preferably reduce an amount of a resin added, but also reduces an amount of a hardening agent added, and thus is significantly affected by the problem. In JP-A 9-47840, JP-A 2006-247716 and JP-A 57-58948, there is no description about the problem for such a reclaimed spherical molding sand.

In addition, JP-A 9-47840 does not describe a low content of phosphoric acid in a hardening agent and a spherical molding sand having a sphericity of 0.95 or more. In JP-A 2006-247716, phosphoric acid is used in a hardening agent in an amount of not less than 30% by weight. JP-A 57-58948 does not describe a molding sand mainly composed of $Al_2O_3$ and a reduced hardening rate as described above.

The present invention provides a method for producing a mold with a reclaimed spherical molding sand, that can prevent a hardening rate from decreasing.

The present invention also intends to solve a problem in production of a mold with a reclaimed spherical molding sand, that an increased concentration of a hardening agent in the reclaimed molding sand having a reduced hardening rate or an increased content of a sulfur element (S %) in the hardening agent leads to an insufficient bench time to result in a reduced final strength.

According to the present invention, in production of a mold with a reclaimed molding sand mainly composed of $Al_2O_3$ obtained from a mold produced with a spherical molding sand, a hardening rate can be prevented from decreasing, and good mold strength, particularly good initial mold strength can be achieved.

Since spherical molding sands mainly composed of $Al_2O_3$ including artificial mullite- and alumina-based molding sands have various favorable properties such as high refractoriness, low heat-expandability and high crushing-resistance, it is useful to prevent reduction of hardening rate of a reclaimed molding sand, leading to effects such as increased quality of a cast article and reduced cost by an increased reclaiming rate of molding sand.

According to the present invention, a bench time for completing hardening of a reclaimed molding sand having reduced hardening rate can be taken sufficiently even when at higher concentration of a hardening agent, or higher content of a sulfur element (S %) in the hardening agent, and a mold having good final strength can be obtained.

Sulfuric acid and phosphoric acid in a hardening agent react with Al in a molding sand to produce base salts. These base salts reduce a hardening rate of an acid-hardening furan resin in a binder. The present invention solves the problem. Use of an organic sulfonic acid reduces generation of such a base salt.

In the present invention, at least one of the hardening agents (I) and (II) contains an organic sulfonic acid, and in the hardening agent, a content of sulfuric acid is not more than 5% by weight and a content of phosphoric acid is not more than 5% by weight. In the present invention, for a new sand used to form a mold, the hardening agent (I) preferably satisfies the conditions, from the viewpoint of prevention of reduced hardening rate in forming a mold with the reclaimed molding sand derived from the new sand, and for a reclaimed molding sand used to form a mold, the hardening agent (II) preferably satisfies the conditions, from the viewpoint of prevention of reduced hardening rate. The present invention also includes the method of production, wherein the hardening agent (I) contains an organic sulfonic acid, and in the hardening agent, a content of sulfuric acid is not more than 5% by weight and a content of phosphoric acid is not more than 5% by weight. From the viewpoint of prevention of a decreased hardening rate in repetitive use of a reclaimed molding sand, the present invention further includes the method of production, wherein both of the hardening agents (I) and (II) preferably contain an organic sulfonic acid, and in the hardening agents, a content of sulfuric acid is not more than 5% by weight and a content of phosphoric acid is not more than 5% by weight.

An embodiment of the present invention will be described below, where the hardening agent (II) contains an organic sulfonic acid, and in the hardening agent, a content of sulfuric acid is not more than 5% by weight and a content of phosphoric acid is not more than 5% by weight.

The reclaimed molding sand used in the embodiment is mainly composed of $Al_2O_3$ and obtained from a mold produced with the spherical molding sand (A) having a sphericity of 0.95 or more, the binder (II) containing an acid-hardening resin and the hardening agent (II). The hardening agent (II) contains an organic sulfonic acid, and in the hardening agent, a content of sulfuric acid is not more than 5% by weight and a content of phosphoric acid is not more than 5% by weight. In the hardening agent (II), sulfuric acid is a substance represented by the chemical formula $H_2SO_4$, and phosphoric acid is a collective term of acids produced by hydration of phosphorus pentoxide, including metaphosphoric acid, pyrophosphoric acid, orthophosphoric acid, phosphoric acid, diphosphoric acid, triphosphoric acid, and tetraphosphoric acid.

In the hardening agent (II), a content of the organic sulfonic acid is preferably 5 to 100% by weight, and more preferably 15 to 100% by weight.

The hardening agent (II) may contain other hardening agents such as sulfuric acid and phosphoric acid together with the organic sulfonic acid. From the viewpoints of maintaining a hardening rate and enhancing strength of a mold formed with the reclaimed molding sand, in the hardening agent (II), a content of sulfuric acid is not more than 5% by weight, preferably not more than 1% by weight, and more preferably substantially 0% by weight. From the same viewpoints, in the hardening agent (II), a content of phosphoric acid is not more than 5% by weight, preferably not more than 1% by weight, and more preferably substantially 0% by weight. The term "substantially" means that such an amount as an impurity may be present.

In some cases, the hardening agent (II) contains an elemental sulfur (S) derived other sources than the organic sulfonic acid and sulfuric acid. From the viewpoints of maintaining a hardening rate and enhancing strength of a mold formed with the reclaimed molding sand, a percentage of elemental S derived from the organic sulfonic acid in the total elemental S in the hardening agent (II) is preferably not less than 80% by weight, more preferably not less than 90% by weight, and even more preferably substantially 100% by weight. From the same viewpoints, a percentage of elemental S derived from sulfuric acid in the total elemental S in the hardening agent (II) is preferably not more than 10% by weight, more preferably not more than 6% by weight, and even more preferably substantially 0% by weight. An amount of elemental phosphorous (P) in the hardening agent (II) is preferably not more than 1% by weight, and more preferably substantially 0% by weight. The term "substantially" means allowance of an amount like as an impurity.

Examples of the organic sulfonic acid used in the hardening agent (I) or (II) include alkane- or aryl-sulfonic acid and phenolsulfonic acids, such as methanesulfonic acid, ethanesulfonic acid, alkylbenzenesulfonic acids such as ethylbenzenesulfonic acid, benzenesulfonic acid, toluenesulfonic acid, and xylenesulfonic acid. From the viewpoint of production cost and the like, preferred is at least one acid selected from xylenesulfonic acid, toluenesulfonic acid, ethylbenzenesulfonic acid, and methanesulfonic acid, and more preferred is at least one acid selected from xylenesulfonic acid, toluenesulfonic acid, and methanesulfonic acid.

The organic sulfonic acid may contain an isomer generated in production thereof. For example, xylenesulfonic acid may contain m-xylene-4-sulfonic acid, m-xylene-2-sulfonic acid, o-xylene-4-sulfonic acid, o-xylene-2-sulfonic acid, p-xylene-2-sulfonic acid, and disulfonic acids such as m-xylene-2,4-disulfonic acid and m-xylene-2,6-disulfonic acid as impurities. These sulfonic acids can be identified by NMR.

The hardening agent (1) or (II) may further contain known acidic substance other than the organic sulfonic acid. Examples of the acidic substance include organic acids such as carboxylic acid and inorganic acids such as nitric acids and mixtures thereof. In this case, amounts of sulfuric acid and phosphorus acid are restricted.

The hardening agent (1) or (II) may further contain a solvent for dilution, such as water or alcohols. From the viewpoint of production cost and the like, preferably used for the solvent are water, methanol, ethanol, and isopropyl alcohol.

In the embodiment of the present invention, by reclaiming a molding sand from a mold produced using the specific hardening agent (II) in which contents of sulfuric and phosphoric acids are reduced, a hardening rate for the reclaimed spherical molding sand, mainly composed of $Al_2O_3$, can be prevented from decreasing. The reason is not clear in detail, but guessed that sulfuric and phosphoric acids react with $Al_2O_3$ on the surface of the molding sand mainly composed of $Al_2O_3$ by heat in production to produce some hardening inhibitors, and that inhibitors affect on subsequent production of a mold with the reclaimed molding sand.

The hardening agent (I) or (II) is used together with the binder (I) or (II) containing the acid-hardening resin. Examples of the acid-hardening resin include acid-hardening furan resins and acid-hardening phenol resins. For the acid-hardening furan resin, well known resins are used. These resins may be used as a binder alone or in combination. Specific examples of the acid-hardening furan resin include furfuryl alcohol, furfuryl alcohol polymers and furfuryl alcohol-aldehyde polycondensation products. Examples further include mixtures and co-condensation products of furfuryl alcohol with phenol-aldehyde polycondensation products, melamine-aldehyde polycondensation products, and urea-aldehyde polycondensation products, and the like. Two or more of these polycondensation products may further co-condensate and be used as the acid-hardening furan resin. As the aldehyde for polycondensation with furfuryl alcohol and the like, conventionally known aldehyde compounds such as formaldehyde, glyoxal and furfural can be used. When phenol-aldehyde polycondensation products are used, conventionally known phenol compounds such as phenol, resorcinol, bisphenol A and bisphenol F can be used alone or in combination. These may be used together with a known modifier.

When the binder (I) or (II) contains the acid-hardening furan resin as the acid-hardening resin, from the viewpoint of further enhancement of mold strength, it preferably contains one or two or more compounds represented by the formula (I):

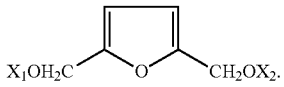

(1)

(wherein, $X_1$ and $X_2$ each represent any one of hydrogen atom, $CH_3$ or $C_2H_5$.)

Examples of the compound represented by the formula (I) include 2,5-bishydroxymethylfuran, 2,5-bismethoxymethylfuran, 2,5-bisethoxymethylfuran, 2-hydroxymethyl-5-methoxymethylfuran, 2-hydroxymethyl-5-ethoxymethyl furan, and 2-methoxymethyl-5-ethoxymethylfuran. These may be used alone or in combination. Particularly preferably used is 2,5-bishydroxymethylfuran.

A content of the compound represented by the formula (I) in the binder (I) or (II) is generally 0.5 to 63.0% by weight, preferably 1.8 to 50.0% by weight, more preferably 2.5 to 50.0% by weight, even more preferably 5.0 to 40.0% by weight, and even more preferably 7.0 to 40.0% by weight. The compound represented by the formula (1) contained in an amount of not less than 0.5% by weight can provide an effect of enhancing strength of a mold due to the compound represented by the formula (1). The compound represented by the formula (1) contained in an amount of not more than 63.0% by weight will quickly dissolve in the acid-hardening resin and can prevent generation of precipitation in the binder.

When the binder (I) or (II) contains the acid-hardening furan resin as the acid-hardening resin, from the viewpoint of enhancement of hardening rate, it preferably contains a polyphenol compound. As the polyphenol compound, synthetic and natural polyphenol compounds can be used. Examples of the polyphenol compound include synthesis products such as catechol, resorcinol, hydroquinone, pyrogallol, and phloroglucinol, and synthetic polyphenol compounds having skeletons derived therefrom, natural polyphenol compounds such as tannin, lignin and catechin, and synthetic polyphenol compounds having skeletons derived therefrom. A content of the polyphenol compound in the binder (I) or (II) is preferably 0.1 to 40% by weight, more preferably 0.1 to 20% by weight, and even more preferably 3 to 10% by weight. The polyphenol compound contained within the range preferably well dissolves without generating precipitation in the acid-hardening resin.

When the binder (I) or (II) is used to produce a mold, a silane coupling agent may further be added in order to increase strength of the mold. For the silane coupling agent, for example, γ-(2-amino) aminopropylmethyldimethoxysilane, γ-aminopropyltrimethoxysilane, γ-aminopropyltriethoxysilane, γ-glycidoxypropyltrimethoxysilane and the like can be used. The silane coupling agent may be added to a kneaded sand by adding the silane coupling agent to the binder (II) or the hardening agent (II), adding the binder (II) or the hardening agent (II) to spherical molding sand (A) and blending them, or directly adding the silane coupling agent to spherical molding sand (A). It is possible to add the silane coupling agent to the binder (I) or the hardening agent (I), add the binder (I) or the hardening agent (I) to spherical molding sand (A) and blend them, or directly add the silane coupling agent to reclaimed molding sand.

For the spherical molding sand (A) used in the present invention, those having higher sphericity can achieve the same strength with smaller amounts of additives used, resulting in smaller amount of the hardening agent added. The problem to be solved by the invention, that is, decreased hardening rate of a reclaimed molding sand particularly becomes significant when an amount of the hardening agent (I) added is small. Therefore, the spherical molding sand (A) used in the present invention has a sphericity of not less than 0.95, more preferably not less than 0.98, and even more preferably not less than 0.99.

In the present invention, since the reclaimed molding sand used is a spherical molding sand, an original sphericity of the spherical molding sand is measured after the spherical molding sand is heat-treated for one hour at 1000° C. to remove residual organic matters on the surface thereof.

A sphericity of the spherical molding sand (A) is determined by taking an image (photograph) of a particle of the sand with an optical microscope or digital microscope (e.g., Keyence Corporation, model VH-8000), analyzing the image to determine an area and a boundary length of a projected cross section of the particle, calculating [circumferential length (mm) of a perfect circle having the same area ($mm^2$) as of the projected cross section of the particle]/[boundary length (mm) of the projected cross section of the particle], collecting values of randomly selected 50 particles of the spherical molding sand, and calculating an average.

From the viewpoints of reduction of an amount of a binder used in forming a mold (increased reclaiming efficiency) and mold strength, an average diameter (mm) of the spherical molding sand (A) is preferably 0.05 to 1.5 mm. From the viewpoint of increased reclaiming efficiency of the spherical molding sand, the average diameter is preferably 0.075 to 1.5 mm. From the viewpoint of increasing mold strength, the average diameter is preferably 0.05 to 1 mm. From the viewpoint of increasing both of reclaiming efficiency and mold strength, the average diameter is preferably 0.075 to 0.5 mm, and more preferably 0.075 to 0.35 mm.

The average particle diameter can be determined as follows. For a particle of the spherical molding sand having a sphericity=1, a diameter (mm) is measured from a projected cross section of the particle. For a particle having sphericity<1, using randomly orientated particles of the spherical molding sand, a major axial diameter (mm) and a minor axial diameter (mm) of a particle are measured, and (major axial diameter+minor axial diameter)/2 is calculated. Values of randomly selected 100 particles of the spherical molding sand are used to calculate an average, which is used as an average particle diameter (mm). A major axial diameter and a minor axial diameter are defined as follows. A particle is stably placed on a plane surface. A projected image of the particle on the plane surface is put between two parallel lines. The narrowest width of the parallel lines is referred to as a minor axial diameter. A width of parallel lines orthogonal to the parallel lines and holding the particle therebetween is referred to as a major axial diameter.

A major axial diameter and a minor axial diameter of a particle of the spherical molding sand can be determined by taking an image of the particle with an optical microscope or digital microscope (e.g., Keyence Corporation, model VH-8000) and analyzing the image.

The spherical molding sand (A) is mainly composed of $Al_2O_3$. A content of $Al_2O_3$ is preferably 20 to 100% by weight, more preferably 40 to 100% by weight, and from the viewpoint of larger effect of the Invention, even more preferably 60 to 100% by weight, and even more preferably 80 to 100% by weight. From the viewpoints of easiness of production of sand and reduction of heat-expansion of a resultant mold, the spherical molding sand (A) preferably contains $SiO_2$, more preferably contains $SiO_2$ in an amount of 40 to 5% by weight, and even more preferably in an amount of 40 to 15% by weight. In the spherical molding sand (A) containing $Al_2O_3$ and $SiO_2$, a weight ratio of $Al_2O_3/SiO_2$ is preferably 1 to 15, more preferably 1.2 to 12, and even more preferably 1.5 to 9. In the present invention, the reclaimed molding sand thus can further contain $SiO_2$.

For the spherical molding sand, those produced by a flame fusion method or melt granulation with atomizing is preferred, because the obtained molding sand has a high sphericity and small irregularities of the surface thereof, resulting in a small amount of a resin added. In these molding sand, although an amount of hardening agent added can be reduced, reduction of hardening rate due to deteriorating properties of the reclaimed molding sand also can be significant. However, the present invention can sufficiently solve the problem of such a spherical molding sand produced by a flame fusion method and melt granulation with atomizing. Accordingly, examples of the preferred spherical molding sand (A) include spherical molding sands of artificial ceramics produced by a flame fusion method such as described in JP-A 2004-202577, artificial ceramic molding sands produced by melt granulation with atomizing [e.g., Espearl (ESUPĀRU) L, H, and S (trade name), produced by Yamakawa Sangyo Co., Ltd., Green beads (GURĪN BĪZU), produced by Kinsei Matec Co., Ltd., and AR-sand (ARUSANDO), produced by Cosmo]. Spherical molding sands produced by a flame fusion method are more preferred.

A mold can be formed with the spherical molding sand (A), the binder (II) containing the acid-hardening resin, and the hardening agent (II) according to a standard method, for example, by adding 0.2 to 3 parts (based on weight, the same is applied to the follows) of the hardening agent (II) to 100 parts of the spherical molding sand, and adding the binder (II) containing a furan resin in an amount corresponding to 0.5 to 5 parts to a mixture, and forming a mold.

A reclaimed molding sand can be produced from a mold according to a known method (e.g., "Igata Zokei Hou (method for forming a mold)", 4th edition, Japan Foundry Society, Inc., 1996 Nov. 18, pp 327-330). Common dry reclaiming (mechanical wearing) and roasting reclaiming methods are employed. A dry method (mechanical wearing) is preferred, because it economically produces sand at high yield.

The present invention is particularly effective for cases of a strong dry reclaiming treatment such as mechanical wearing and a roasting reclaiming treatment in order to control an amount of residual resin in a reclaimed molding sand at low level.

From the viewpoints of maintaining a hardening rate and increasing strength of a mold, the reclaimed molding sand preferably has an elution amount of elemental aluminum of not more than 50 μg, more preferably not more than 40 μg, and even more preferably not more than 30 μg per 1 g of sand as measured by the following method.

(Method for Measuring an Elution Amount of Elemental Aluminum)

25 g of reclaimed molding sand is weighed in a beaker. To this is added 50 ml of 0.1 N—HCL aqueous solution, and stirred for 15 minutes. The mixture is allowed to stand for 5 minutes. A supernatant is filtered through a filtering paper. An elemental aluminum in the filtered supernatant is quantified by ICP analysis (Inductively Coupled Plasma Emission Spectrometry), and used to calculate an elution amount per 1 g of reclaimed molding sand.

In reclaiming the spherical molding sand (A), an elution amount of elemental aluminum can be controlled by controlling strength of mechanical reclaiming (the number of treatment steps, a treatment time, a rotation number of a reclaiming machine) and modifying roasting reclaiming conditions (temperature, time), and conditions of forming a mold (a sand/metal ratio, an amount of hardening agent added). For example, in a mold with low sand/metal ratio, many parts in the mold are exposed to high temperature, and thus sulfuric acid and phosphoric acid react with aluminium in the sand to increase an elution amount of aluminum. Larger amount of hardening agent added is equal to larger amounts of sulfuric acid and phosphoric acid to the sand, resulting in larger elution amount of aluminium.

From the viewpoint of prevention of cast defects, the reclaimed molding sand has preferably a small ignition loss. The effect of the present invention is remarkable when the ignition loss is not more than 3% by weight, preferably not more than 2% by weight, more preferably not more than 1% by weight, and even more preferably 0.5% by weight. The term "ignition loss" refers a weight change ratio derived from adsorbed water, interlayer water, and pyrolytic substances, which remain in the molding sand, and is represented by percentage by weight. In the present invention, an ignition loss is measured according to "test method for ignition loss of molding sand" defined in Japan Foundry Society, Inc. standard: "JACT test method S-2"

When the ignition loss is 0.6 to 3% by weight, a mold having good initial strength, or a mold in which a hardening rate is prevented from decreasing can be produced. Thus an elution amount of elemental aluminum per 1 g of reclaimed molding sand measured according to the above-mentioned method is preferably not more than 100 mg, more preferably not more than 90 μg, even more preferably not more than 80 μg, and even more preferably 70 μg.

In the present invention, a mold is produced with the reclaimed molding sand having a specific record as described above, the binder (I) containing the acid-hardening resin, and the hardening agent (I).

The binder (I) used may be same to or different from the binder (II). Preferred embodiment thereof is also same to that of the binder (II). The binder (I) preferably contains an acid-hardening furan resin as an acid-hardening resin. In this case, the binder (I) preferably contains one or two or more compounds represented by the formula (1) and/or a polyphenol compounds. From the viewpoint of repetitive use of the reclaimed molding sand, the hardening agent (I) used, which may be the same as or different from the hardening agent (II), preferably satisfies the preferred embodiment of the hardening agent (II).

That is, the hardening agent (I) contains an organic sulfonic acid in an amount of 5 to 100% by weight, more preferably 15 to 100% by weight.

The hardening agent (I) can contain other hardening agents such as sulfuric acid and phosphoric acid together with the organic sulfonic acid. From the viewpoints of maintaining a hardening rate and enhancing strength of a mold formed with the reclaimed molding sand, a content of sulfuric acid in the hardening agent (I) is not more than 5% by weight, preferably not more than 1% by weight, and more preferably substantially 0% by weight. From the same viewpoints, a content of phosphoric acid in the hardening agent (I) is not more than 5% by weight, preferably not more than 1% by weight, and more preferably substantially 0% by weight. The term "substantially" means allowance of such an amount like as an impurity.

In some cases, the hardening agent (I) contains an elemental sulfur (S) derived other sources than the organic sulfonic acid and sulfuric acid. From the viewpoints of maintaining a hardening rate and enhancing strength of a mold formed with the reclaimed molding sand, a percentage of elemental S derived from the organic sulfonic acid in the total elemental S in the hardening agent (I) is preferably not less than 80% by weight, more preferably not less than 90% by weight, and even more preferably substantially 100% by weight. From the same viewpoints, a percentage of elemental S derived from sulfuric acid in the total elemental S in the hardening agent (I) is preferably not more than 10% by weight, more preferably not more than 6% by weight, and even more preferably substantially 0% by weight. An amount of elemental phosphorous (P) in the hardening agent (I) is preferably not more than 1% by weight, and more preferably substantially 0% by weight. The term "substantially" means allowance of inclusion like as an impurity.

A mold can be formed with the reclaimed molding sand, the binder (I), and the hardening agent (I), for example, by adding 0.2 to 3 parts (based on weight, the same is applied to the follows) of the hardening agent (I) to 100 parts of the reclaimed molding sand, and adding the binder (I) containing an acid-hardening furan resin in an amount corresponding to 0.5 to 5 parts, and forming a mold. From the viewpoint of increasing a hardening rate, a method of adding firstly the binder (I) and next the hardening agent (I) is preferred. A mixed sand thus obtained may be used in a whole mold or in a part required. For example, the mixed sand may be used as a facing sand, and common sand containing silica sand may be used as a backing sand. In forming a mold, known additives such as an additive for facilitating hardening may be used.

Contents of the organic sulfonic acid, sulfuric acid and phosphoric acid in the hardening agents (I) and (II) can be identified by potentiometric titration, elemental analysis and/or NMR.

From the viewpoint of prevention of reduced hardening rate of future reclaimed molding sand, an amount of the hardening agent (I) or (II) added is preferably 0.1 to 1 part by weight, more preferably 0.1 to 0.7 part by weight, and even more preferably 0.2 to 0.5 part by weight to 100 parts by weight of reclaimed molding sand.

In casting, a sand/metal ratio (weight ratio of mold/molten metal) is preferably 0.5 to 4.

A kneaded sand thus obtained is filled in a flask and allowed to stand for predetermined time at normal temperature. During this time, the acid-hardening furan resin hardens to give a mold.

The present invention is based on the finding that, in repetitive use of a molding sand having a sphericity of 0.95 or more, mainly composed of $Al_2O_3$, for forming a mold and reclaiming, a mold produced under the specific conditions exerts a positive influence on production of a new mold being prevented form decreasing a hardening rate, as far as the sand is reclaimed under the same conditions. The present invention provides a method of repetitive use of a molding sand having a sphericity of 0.95 or more mainly composed of $Al_2O_3$ for forming a mold and reclaiming the molding sand from the mold, wherein the mold is produced using (1) the molding sand having a sphericity of 0.95 or more mainly composed of $Al_2O_3$, (2) the binder containing the acid-hardening resin, and (3) the hardening agent containing the organic sulfonic acid, where contents of sulfuric acid and phosphoric acid in the hardening agent are not more than 5% by weight and not more than 5% by weight respectively.

The above embodiments describe the preferred method of producing a mold according to the present invention, but other methods can also be employed. For example, in the description, production of a kneaded sand, filling of a kneaded sand and hardening of the binder are carried out at normal temperature, but these may be carried out with heating. From the viewpoint of increased initial strength and securement of a bench time, production of a mold may be carried out at not lower than 30° C., preferably 35 to 60° C., and more preferably 35 to 50° C. The temperature can be applied at any one or more stages of production of kneaded sand from the reclaimed molding sand, filling of a kneaded sand and hardening of the binder (I), but the effects are more significant at stages after kneading and of filling. A thermosetting furan warm box method can also be applied. The method of producing a mold of the present invention is widely applicable to production of various molds.

For a spherical molding sand mainly composed of $Al_2O_3$, a reclaimed molding sand having been used with an acid-hardening binder has the following problem in hardening again with an acid-hardening resin.

When forming a mold having a higher initial strength by increasing an added amount of a hardening agent or increasing S % in a hardening agent in order to shorten a time of stripping a flask from the mold under high temperature conditions such as in summer, the reclaimed molding sand has shorter bench time of a binder than that of a reclaimed silica molding sand, resulting in reduced final mold strength. Use of the reclaimed molding sand having been used with the hardening agent containing the organic sulfonic acid and containing small amounts of sulfuric acid and phosphoric acid, respectively, according to the present invention, leads few generation of aluminum salts that affect adversely on hardening of a resin, and thus can prevent reduction of a bench time in the cases of forming a mold having high initial strength under high temperature conditions as described above, resulting in increased final mold strength. Also from these viewpoints, the hardening agent (II) preferably contains the organic sulfonic acid and small amounts of sulfuric acid and phosphoric acid according to the present invention.

Experiment Test

The following tests demonstrate the present invention. Tests are intended to illustrate the present invention and not to limit the present invention.

<Test 1>

Test 1-1

To 100 parts by weight of spherical artificial molding sand having a sphericity of 0.99, and containing $SiO_2$ and $Al_2O_3$ at an $Al_2O_3/SiO_2$ ratio (weight ratio) of 1.9 in a total amount of 94% by weight (other ingredients were $TiO_2$: 2.9% by weight, $Fe_2O_3$: 1.3% by weight, and trace amounts of CaO, MgO, $Na_2O$, and $K_2O$) were added 0.24 parts by weight of aqueous solution of 61% by weight of p-toluenesulfonic acid (content of elemental S: 11.3% by weight), which was a hardening agent (hardening agent (II)), and then 0.6 parts by weight of furan resin (Kao-Quaker Co., Ltd., Kao Lightner EF-5402), which was the binder (II), kneaded and formed into a test mold. The test mold was used to produce a cast article at a mold/molten metal weight ratio of 2. Sand was collected and crushed with a crusher to give a collected sand. The collected sand was subjected to a mechanical reclaiming treatment with a Hybrid Sand Master HSM1115 (Nippon Chuzo Co., Ltd.) for 30 minutes at 2600 rpm and at a treating amount of 80 kg to give a reclaimed molding sand.

The resultant reclaimed molding sand was measured for an elution amount of elemental aluminum. Under conditions of 25° C. and 55% RH, to 100 parts by weight of the sand were added 0.28 parts by weight of aqueous solution (content of sulfuric acid: 0% by weight, content of phosphoric acid: 0% by weight) of 61% by weight of p-toluenesulfonic acid (content of elemental S: 11.3% by weight), which was a hardening agent (hardening agent (I)), and then 0.7 parts by weight of the furan resin, which was the binder (I), kneaded, and immediately formed into a cylindrical test piece having a diameter of 50 mm and a height of 50 mm. The test piece was measured for compressive strength after 0.5, 1 and 24 hours. The results are shown in Table 1.

Test 1-2

The collected sand in Test 1-1 was roasted for one hour at 500° C. to give a roasted reclaimed molding sand. The sand was similarly evaluated for an elution amount of elemental aluminum and hardening behavior as described in Test 1-1. The results are shown in Table 1.

Test 1-3

A reclaimed molding sand was similarly prepared as in Test 1-1 by forming a mold, using the mold for casting, and mechanically reclaiming the molding sand, except that the hardening agent (II) used was an aqueous solution of 35% by weight of sulfuric acid (content of elemental S: 11.4% by weight). The sand was similarly evaluated for an elution amount of elemental aluminum and hardening behavior as described in Test 1-1. The results are shown in Table 1.

Test 1-4

A roasted reclaimed molding sand was similarly prepared as in Test 1-2, except that the collected sand used was that obtained in Test 1-3. The sand was similarly evaluated for an elution amount of elemental aluminum and hardening behavior as described in Test 1-1. The results are shown in Table 1.

Test 1-5

To 100 parts by weight of spherical artificial molding sand used in Test 1-1 were added 0.24 parts by weight of aqueous solution of 2% by weight of sulfuric acid (content of elemental S: 0.7% by weight) and 64% by weight of xylenesulfonic acid (content of elemental S: 11.0% by weight), which was a hardening agent (hardening agent (II)), and then 0.6 parts by weight of furan resin (Kao-Quaker Co., Ltd., Kao Lightner EF-5402), which was the binder (II), kneaded, and formed into a test mold. The test mold was used to produce a cast article at a mold/molten metal weight ratio of 2. Sand was collected and crushed with a crusher to give a collected sand. The collected sand was similarly reclaimed as in Test 1-1 with a Hybrid Sand Master (Nippon Chuzo Co., Ltd.). A cycle of adding the resin and the hardening agent to the reclaimed molding sand, forming a mold, casting, collecting and reclaiming was repeated five times. A reclaimed molding sand after five cycles was similarly evaluated for an elution amount of elemental aluminum and hardening behavior as described in Test 1-1. The results are shown in Table 1.

Test 1-6

A reclaimed molding sand was similarly prepared as in Test 1-1 by forming a mold, using the mold for casting, and mechanically reclaiming the molding sand, except that the hardening agent (II) used was an aqueous solution of 34% by weight of methanesulfonic acid (content of elemental S: 11.3% by weight). The sand was similarly evaluated for an elution amount of elemental aluminum and hardening behavior as described in Test 1-1. The results are shown in Table 1.

Test 1-7

The collected sand in Test 1-6 was roasted for one hour at 500° C. to give a roasted reclaimed molding sand. The sand was similarly evaluated for an elution amount of elemental aluminum and hardening behavior as described in Test 1-1. The results are shown in Table 1.

Test 1-8

To 100 parts by weight of spherical artificial molding sand used in Test 1-1 were added 0.24 parts by weight of aqueous solution of 66% by weight of xylenesulfonic acid (content of elemental S: 11.3% by weight), which was a hardening agent (hardening agent (II)), and then 0.6 parts by weight of solution containing 10 parts by weight of polyphenol compound (methanol extract of *Acacia mangium* GKA-100 commercially available from Koshii Wood Solutions Co. Ltd.) and 90 parts by weight of furan resin (Kao-Quaker Co., Ltd., Kao Lightner EF-5402), which was the binder (II), kneaded, and formed into a test mold. The test mold was used to produce a cast article at a mold/molten metal weight ratio of 2. Sand was collected and crushed with a crusher to give a collected sand. The collected sand was similarly mechanically reclaimed as in Test 1-1 with a Hybrid Sand Master HSM1115 (Nippon Chuzo Co., Ltd.). The reclaimed molding sand was similarly evaluated for an elution amount of elemental aluminum and hardening behavior as described in Test 1-1. The results are shown in Table 1.

Test 1-9

Under conditions of 25° C. and 55% RH, to 100 parts by weight of the reclaimed molding sand produced in Test 1-8 were added 0.28 parts by weight of aqueous solution of 61% by weight of p-toluenesulfonic acid (content of elemental S: 11.3% by weight), which was a hardening agent (hardening agent (I)), and then 0.7 parts by weight of solution containing 10 parts by weight of polyphenol compound (methanol extract of *Acacia mangium* GKA-100 commercially available from Koshii Wood Solutions Co. Ltd.) and 90 parts by weight of furan resin (Kao-Quaker Co., Ltd., Kao Lightner EF-5402), which was the binder (I), kneaded, and immediately formed into a cylindrical test piece having a diameter of 50 mm and a height of 50 mm. The test piece was similarly measured for compressive strength after 0.5, 1 and 24 hours as in Test 1-1. The results are shown in Table 1.

Test 1-10

A cycle of forming a mold, casting, collecting and reclaiming was similarly repeated five times as in Test 1-5, except that the hardening agent (II) used was an aqueous solution (content of sulfuric acid: 9.4% by weight, content of phosphoric acid: 0% by weight) of 9.4% by weight of sulfuric acid (content of elemental S: 3.1% by weight) and 50% by weight of xylenesulfonic acid (content of elemental S: 8.6% by weight). A reclaimed molding sand after five cycles was similarly evaluated for an elution amount of elemental aluminum and hardening behavior as described in Test 1-1. The results are shown in Table 1.

(hardening agent (II)), and then 0.7 parts by weight of furan resin (Kao-Quaker Co., Ltd., Kao Lightner EF-5402), which was the binder (II), kneaded, and immediately formed into a cylindrical test piece having a diameter of 50 mm and a height of 50 mm. The test piece was measured for compressive strength after 0.5, 1 and 24 hours. The spherical artificial molding sand (new sand) used in this test was similarly evaluated for an elution amount of elemental aluminum and hardening behavior as described in Test 1-1. The results are shown in Table 1. In Table 1, amounts (% by weight) of sulfuric acid and phosphoric acid derived from the hardening agent (II) in forming a mold refers calculated amounts (% by weight) of sulfuric acid and phosphoric acid in a mold formed using the hardening agent (II).

TABLE 1

| | | Contents in the hardening agent (II) (% by weight) | | | | | amounts of sulfuric acid and phosphonic acid in a mold derived from the hardening agent (II) (% by weight) | | Reclaimed molding sand | | Compressive strength(MPa) | | |
|---|---|---|---|---|---|---|---|---|---|---|---|---|---|
| | | Organic sulfonic acid | | | | | | | Ignition loss (LOI) (% by weight) | Elution amount of elemental alminum (μg/g) | after 0.5 hours | After 1 hour | After 24 hours |
| | | p-toluen-sulfonic acid | Xylene-sulfonic acid | methane-sulfonic acid | Sulfuric acid | Phospho-ric acid | Sulfuric acid | Phosphoric acid | | | | | |
| Test | 1-1 | 61 | 0 | 0 | 0 | 0 | 0 | 0 | 0.14 | 34 | 0.68 | 1.78 | 7.74 |
| | 1-2 | 61 | 0 | 0 | 0 | 0 | 0 | 0 | 0.00 | 28 | 1.13 | 2.53 | 7.29 |
| | 1-3 | 0 | 0 | 0 | 35 | 0 | 0.084 | 0 | 0.27 | 86 | 0.24 | 0.85 | 4.48 |
| | 1-4 | 0 | 0 | 0 | 35 | 0 | 0.084 | 0 | 0.03 | 82 | 0.27 | 1.09 | 7.00 |
| | 1-5 | 0 | 64 | 0 | 2 | 0 | 0.005 | 0 | 0.23 | 40 | 0.60 | 1.70 | 6.40 |
| | 1-6 | 0 | 0 | 34 | 0 | 0 | 0 | 0 | 0.12 | 22 | 1.20 | 2.54 | 7.50 |
| | 1-7 | 0 | 0 | 34 | 0 | 0 | 0 | 0 | 0.00 | 21 | 1.23 | 2.60 | 7.80 |
| | 1-8 | 0 | 66 | 0 | 0 | 0 | 0 | 0 | 0.20 | 24 | 1.30 | 2.65 | 7.80 |
| | 1-9 | 0 | 66 | 0 | 0 | 0 | 0 | 0 | 0.20 | 24 | 1.50 | 2.85 | 7.90 |
| | 1-10 | 0 | 50 | 0 | 9.4 | 0 | 0.023 | 0 | 0.25 | 90 | 0.10 | 0.50 | 3.90 |
| | 1-11 | 0 | 16 | 0 | 2.5 | 55 | 0.006 | 0.132 | 0.39 | 60 | 0.19 | 0.73 | 7.31 |
| | 1-12 | 0 | 50 | 0 | 0 | 5.5 | 0 | 0.012 | 0.30 | 55 | 0.22 | 0.82 | 7.52 |
| Reference test 1 | | — | — | — | — | — | | | 0.00 | 12 | 1.45 | 2.95 | 7.98 |

Test 1-11

A reclaimed molding sand was similarly prepared as in Test 1-1 by forming a mold, using the mold for casting, and mechanically reclaiming the molding sand, except that the hardening agent (II) used was an aqueous solution of 2.5% by weight of sulfuric acid (content of elemental S: 1.0%), 55% by weight of phosphoric acid (content of elemental P: 17% by weight) and 16% by weight of xylenesulfonic acid (content of elemental S: 2.8% by weight). The sand was similarly evaluated for an elution amount of elemental aluminum and hardening behavior as described in Test 1-1. The results are shown in Table 1.

Test 1-12

A reclaimed molding sand was similarly prepared as in Test 1-1 by forming a mold, using the mold for casting, and mechanically reclaiming the molding sand, except that the hardening agent (II) used was an aqueous solution of 5.5% by weight of phosphoric acid (content of elemental P: 1.7% by weight) and 50% by weight of xylenesulfonic acid (content of elemental S: 8.6% by weight). The sand was similarly evaluated for an elution amount of elemental aluminum and hardening behavior as described in Test 1-1. The results are shown in Table 1.

Reference Test 1

Under conditions of 25° C. and 55% RH, to 100 parts by weight of spherical artificial molding sand (new sand) used in Test 1-1 were added 0.28 parts by weight of aqueous solution of 61% by weight of p-toluenesulfonic acid (content of elemental S: 11.3% by weight), which was a hardening agent As comparing Reference Test 1 using the new sand, in Tests 1-1, 1-2, and 1-5 to 1-9, reduction of initial strength (after 0.5 and 1 hour) is prevented. As shown in Tests 1-1, 1-2, and 1-5 to 1-9, use of the reclaimed molding sand used with the hardening agent (II) containing the organic sulfonic acid and small amounts of sulfuric acid and phosphoric acid can provide a method for producing a mold having good initial strength, or a mold in which a hardening rate is prevented from decreasing.

<Test 2>

Test 2-1

To 100 parts by weight of spherical artificial molding sand as described in Test 1-1 were added 0.24 parts by weight of aqueous solution of 8% by weight of sulfuric acid (content of elemental S: 2.6%) and 75% by weight of phosphoric acid (content of elemental P: 23% by weight), which was a hardening agent (hardening agent (II)), and then 0.6 parts by weight of furan resin (Kao-Quaker Co., Ltd., Kao Lightner EF-5402), which was the binder (II), kneaded, and formed into a test mold. The test mold was used to produce a cast article at a mold/molten metal weight ratio of 5. Sand was collected and crushed with a crusher to give a collected sand. The collected sand was subjected to a mechanical reclaiming treatment at 2290 rpm and 3 t/hour four times with a rotary reclaimer model M (Nippon Chuzo Co., Ltd.) to give a reclaimed molding sand. A cycle of adding the resin and the hardening agent to the reclaimed molding sand, forming a mold, casting, collecting and reclaiming was repeated five times. A reclaimed molding sand after five cycles was similarly evaluated for an elution amount of elemental aluminum and hardening behavior as described in Test 1-1. The results are shown in Table 2.

Test 2-2

A cycle of forming a mold, casting, collecting and reclaiming was similarly repeated five times as in Test 2-1, except that the hardening agent (II) used was an aqueous solution of 61% by weight of p-toluenesulfonic acid (content of elemental S: 11.3% by weight). A reclaimed molding sand after five cycles was similarly evaluated for an elution amount of elemental aluminum and hardening behavior as described in Test 2-1. The results are shown in Table 2.

Test 2-3

To 100 parts by weight of spherical artificial molding sand as described in Test 1-1 were added 0.24 parts by weight of aqueous solution of 33% by weight of xylenesulfonic acid (content of elemental S: 5.7% by weight), which was a hardening agent (hardening agent (II)), and then 0.8 parts by weight of furan resin (Kao-Quaker Co., Ltd., Kao Lightner EF-5402), which was the binder (II), kneaded, and formed into a test mold. The test mold was used to produce a cast article at a mold/molten metal weight ratio of 4. Sand was collected and crushed with a crusher to give a collected sand. The collected sand was subjected to the similar mechanical reclaiming treatment once as in Test 2-1 with a rotary reclaimer (Nippon Chuzo Co., Ltd.) to give a reclaimed molding sand. A cycle of adding the resin and the hardening agent to the reclaimed molding sand, forming a mold, casting, collecting and reclaiming was repeated five times. A reclaimed molding sand after five cycles was similarly evaluated for an elution amount of elemental aluminum and hardening behavior as described in Test 1-1. The results are shown in Table 2.

Test 2-4

A reclaimed molding sand was similarly prepared as in Test 2-3, except that the hardening agent (II) used was an aqueous solution of 18% by weight of sulfuric acid (content of elemental S: 5.9% by weight). A reclaimed molding sand obtained after five cycles was similarly evaluated for an elution amount of elemental aluminum and hardening behavior as described in Test 1-1. The results are shown in Table 2.

TABLE 2

| | | Contents in the hardening agent (II) (% by weight) | | | | Amounts of sulfuric acid and phosphoric acid in a mold derived from the hardening agent (II) (% by weight) | | Reclaimed molding sand | | Compressive strength(MPa) | | |
|---|---|---|---|---|---|---|---|---|---|---|---|---|
| | | Organic sulfonic acid | | | | | | | | | | |
| | | p-toluene-sulfonic acid | Xylene-sulfonic acid | Sulfuric acid | Phospho-ric acid | Sulfuric acid | Phosphonic acid | Ignition loss (LOI) (% by weight) | Elution amount of elemental alminum (μg/g) | after 0.5 hour | After 1 hour | After 24 hours |
| Test | 2-1 | 0 | 0 | 8 | 75 | 0.019 | 0.18 | 0.34 | 60 | 0.27 | 1.00 | 7.30 |
| | 2-2 | 61 | 0 | 0 | 0 | 0 | 0 | 0.35 | 26 | 1.20 | 2.50 | 7.50 |
| | 2-3 | 0 | 33 | 0 | 0 | 0 | 0 | 2.00 | 30 | 1.40 | 2.60 | 6.00 |
| | 2-4 | 0 | 0 | 18 | 0 | 0.043 | 0 | 1.80 | 70 | 0.30 | 1.20 | 5.20 |

As shown in Tests 2-2 and 2-3, use of the hardening agent (II), containing the organic sulfonic acid and small amounts of sulfuric acid and phosphoric acid, can provide a method for producing a mold having a good initial strength or a mold in which a hardening rate is prevented from decreasing, even from molding sand repeatedly used and reclaimed.

<Test 3>

Test 3-1

Under conditions of 25° C. and 55% RH, to 100 parts by weight of the reclaimed molding sand obtained in Test 1-1 were added 0.28 parts by weight of aqueous solution (content of sulfuric acid: 2% by weight, content of phosphoric acid: 0% by weight) of 63% by weight of xylenesulfonic acid and 2% by weight of sulfuric acid (content of elemental S: 11.5% by weight), which was a hardening agent (hardening agent (I)), and then 0.7 parts by weight of furan resin (Kao-Quaker Co., Ltd., Kao Lightner EF-5402), which was the binder (I), kneaded, and immediately formed into a cylindrical test piece having a diameter of 50 mm and a height of 50 mm. The test piece was measured for compressive strength after 0.5, 1 and 24 hours. The results are shown in Table 3.

Test 3-2

Hardening behavior was similarly measured as in Test 3-1, except that the reclaimed molding sand obtained in Test 1-3 was used. The results are shown in Table 3.

TABLE 3

| | | Compressive strength (MPa) | | |
|---|---|---|---|---|
| | | After 0.5 hour | After 1 hour | After 24 hours |
| Test | 3-1 | 0.68 | 1.62 | 6.49 |
| | 3-2 | 0.41 | 1.04 | 5.56 |

As compared with Test 3-2, in Test 3-1, reduction of initial strength (after 0.5 hour and 1 hour) is prevented. Use of the reclaimed molding sand used with the hardening agent (II) containing the organic sulfonic acid and small amounts of sulfuric acid and phosphoric acid can provide a method for producing a mold having good initial strength, or a mold in which a hardening rate is prevented from decreasing.

<Test 4>

Test 4-1

To 100 parts by weight of spherical artificial molding sand having a sphericity of 0.93, and containing $SiO_2$ and $Al_2O_3$ at an $Al_2O_3/SiO_2$ ratio (weight ratio) of 1.6 in a total amount of 98% by weight were added 0.24 parts by weight of aqueous solution of 61% by weight of p-toluenesulfonic acid (content of elemental S: 11.3% by weight), which was a hardening agent (hardening agent (II)), and then 0.6 parts by weight of furan resin (Kao-Quaker Co., Ltd., Kao Lightner EF-5402), which was the binder (II), kneaded, and formed into a test mold. The test mold was used to produce a cast article at a mold/molten metal weight ratio of 2. Sand was collected and crushed with a crusher to give a collected sand. The collected sand was roasted for one hour at 500° C. to give a roasted raw molding sand. The sand was similarly evaluated for an elution amount of elemental aluminum and hardening behavior as described in Test 1-1. The results are shown in Table 4.

Test 4-2

To 100 parts by weight of spherical artificial molding sand obtained in Test 4-1 were added 0.28 parts by weight of aqueous solution of 3.7% by weight of sulfuric acid (content of elemental S: 1.2%), 57% by weight of phosphoric acid (content of elemental P: 18% by weight) and 19% by weight of xylenesulfonic acid (content of elemental S: 3.3% by weight), which was a hardening agent, and then 0.7 parts by weight of furan resin (Kao-Quaker Co., Ltd., Kao Lightner EF-5501), which was the binder (II), kneaded, and formed into a test mold. The test mold was used to produce a cast article at a mold/molten metal weight ratio of 4. Sand was collected and crushed with a crusher to give a collected sand. The collected sand was subjected to a mechanical reclaiming treatment at 2290 rpm and 3 t/hour once with a rotary reclaimer model M (Nippon Chuzo Co., Ltd.) to give a reclaimed molding sand. A cycle of adding the resin and the hardening agent to the reclaimed molding sand, forming a mold, casting, collecting and reclaiming was repeated six times. A reclaimed molding sand after six cycles was similarly evaluated for an elution amount of elemental aluminum and hardening behavior as described in Test 1-1. The results are shown in Table 4.

A cycle of adding the resin and the hardening agent to the reclaimed molding sand, forming a mold, casting, collecting and reclaiming was repeated five times. A reclaimed molding sand after five cycles was obtained.

The resultant molding sand was measured for an elution amount of elemental aluminum. Under conditions of 25° C. and 55% RH, to 100 parts by weight of the reclaimed molding sand were added 0.28 parts by weight of aqueous solution (content of sulfuric acid: 0% by weight, content of phosphoric acid: 0% by weight) of 65% by weight of xylenesulfonic acid (content of elemental S: 11.7% by weight), which was a hardening agent (hardening agent (I)), and then 0.7 parts by weight of the furan resin as above, which was the binder (I), kneaded, and immediately formed into a cylindrical test piece having a diameter of 50 mm and a height of 50 mm. The test piece was measured for compressive strength after 0.5, 1 and 24 hours. The results are shown in Table 5.

Test 5-2

A reclaimed molding sand was similarly prepared as in Test 5-1 by forming a mold, using the mold for casting, and mechanically reclaiming the molding sand, except that the hardening agent (II) used was an aqueous solution (content of sulfuric acid: 9.4% by weight, content of phosphoric acid: 0% by weight) of 9.4% by weight of sulfuric acid (content of elemental S: 3.1% by weight) and 50% by weight of xylenesulfonic acid (content of elemental S: 8.6% by weight). The reclaimed molding sand was similarly evaluated for an elution amount of elemental aluminum and hardening behavior as described in Test 5-1. The results are shown in Table 5.

TABLE 4

| | | Contents in the hardening agent (II) (% by weight) | | | | | Amounts of sulfonic acid and phosphonic acid in a mold derived from the hardening agent (II) (% by weight) | | Reclaimed molding sand | | Compressive strength(MPa) | | |
|---|---|---|---|---|---|---|---|---|---|---|---|---|---|
| | | Organic sulfonic acid | | | | | | | Ignition loss (LOI) (% by weight) | Elution amount of elemental alminum (μg/g) | After 0.5 hour | After 1 hour | After 24 hours |
| | | p-toluene sulfonic acid | Xylene sulfonic acid | Methane sulfonic acid | Sulfuric acid | Phosphoric acid | Sulfuric acid | Phophoric acid | | | | | |
| Test | 4-1 | 61 | 0 | 0 | 0 | 0 | 0 | 0 | 0 | 124 | 0 | 0 | 1.10 |
| | 4-2 | 0 | 19 | 0 | 3.7 | 57 | 0.01 | 0.16 | 2.23 | 260 | 0.01 | 0.16 | 3.38 |

<Test 5>

Test 5-1

To 100 parts by weight of spherical artificial molding sand used in Test 1-1 were added 0.28 parts by weight of aqueous solution of 65% by weight of xylenesulfonic acid (content of elemental S: 11.7% by weight), which was a hardening agent (hardening agent (II)), and then 0.7 parts by weight of furan resin (Kao-Quaker Co., Ltd., Kao Lightner EF-5402), which was the binder (II), kneaded, and formed into a test mold. The test mold was used to produce a cast article at a mold/molten metal weight ratio of 2. Sand was collected and crushed with a crusher to give a collected sand. The collected sand was treated with a Hybrid Sand Master (Nippon Chuzo Co., Ltd.) in the same way as Test 1-1 to give a reclaimed molding sand.

TABLE 5

| | | Contents in the hardening agent (II) (% by weight) | | | | | Reclaimed molding sand | | Compressive strength(MPa) | | |
|---|---|---|---|---|---|---|---|---|---|---|---|
| | | Organic sulfonic acid | | | | | Ignition loss (LOI) (% by weight) | Elution amount of elemental aluminum (μg/g) | After 0.5 hour | After 1 hour | After 24 hours |
| | | p-toluene sulfonic acid | Xylene sulfonic acid | Methane sulfonic acid | Sulfuric acid | Phosphoric acid | | | | | |
| Test | 5-1 | 0 | 65 | 0 | 0 | 0 | 0.7 | 66 | 0.63 | 1.40 | 4.15 |
| | 5-2 | 0 | 50 | 0 | 9.4 | 0 | 0.9 | 122 | 0.17 | 0.84 | 4.11 |

In Test 5-2, initial strength was reduced. In Test 5-1, initial strength (after 0.5 hour and 1 hour) was prevented from reducing. As shown in Test 5-1, use of the reclaimed molding sand used with the hardening agent (II) containing the organic sulfonic acid and small amounts of sulfuric acid and phosphoric acid can provide a method of producing a mold having a good initial strength, or a mold in which a hardening rate is prevented from decreasing, even in a high LOI area.

<Test 6>

Test 6-1

Hardening behavior was similarly measured as in Test 5-1, except that under conditions of 35° C. and 55% RH, to 100 parts by weight of the reclaimed molding sand obtained in Test 5-1 was added an aqueous solution (content of sulfuric acid: 0% by weight, content of phosphoric acid: 0% by weight) of 44% by weight of xylenesulfonic acid (content of elemental S: 7.6% by weight), which was the hardening agent (I). The results are shown in Table 6.

Test 6-2

Hardening behavior was similarly measured as in Test 6-1, except that the hardening agent (I) used was an aqueous solution (content of sulfuric acid: 0% by weight, content of phosphoric acid: 0% by weight) of 55% by weight of xylenesulfonic acid (content of elemental S: 9.5% by weight). The results are shown in Table 6.

Test 6-3

Hardening agent was similarly measured as in Test 5-2, except that under conditions of 35° C. and 55% RH, to 100 parts by weight of the reclaimed molding sand obtained in Test 5-2 was added an aqueous solution (content of sulfuric acid: 7.2% by weight, content of phosphoric acid: 0% by weight) of 7.2% by weight of sulfuric acid (content of elemental S: 2.4% by weight) and 41% by weight of xylenesulfonic acid (content of elemental S: 7.1% by weight), which was the hardening agent (I). The results are shown in Table 6.

Test 6-4

Hardening behavior was similarly measured as in Test 6-3, except that the hardening agent (I) used was an aqueous solution (content of sulfuric acid: 8.1% by weight, content of phosphoric acid: 0% by weight) of 8.1% by weight of sulfuric acid (content of elemental S: 2.6% by weight) and 51% by weight of xylenesulfonic acid (content of elemental S: 8.8% by weight). The results are shown in Table 6.

TABLE 6

| | | Contents in the hardening agent (I) (% by weight) | | | | | Compressive strength(MPa) | | |
|---|---|---|---|---|---|---|---|---|---|
| | | Organic sulfonic acid | | | | | | | |
| | | p-toluene sulfonic acid | Xylene sulfonic acid | methane sulfonic acid | Sulfuric acid | Phosphoric acid | After 0.5 hour | After 1 hour | After 24 hours |
| Test | 6-1 | 0 | 44 | 0 | 0 | 0 | 0.02 | 0.33 | 3.00 |
| | 6-2 | 0 | 55 | 0 | 0 | 0 | 0.68 | 1.44 | 3.53 |
| | 6-3 | 0 | 41 | 0 | 7.2 | 0 | 0.32 | 0.79 | 2.84 |
| | 6-4 | 0 | 51 | 0 | 8.1 | 0 | 0.75 | 1.42 | 2.55 |

Under high temperature conditions, in Test 6-3, an increased S % in the hardening agent like as in Test 6-4 to shorten a time of stripping a flask from the mold leads increased initial strength (after 0.5 and one hour) but also leads shortened bench time of the binder, resulting in decreased final strength. In contrast, in Test 6-2, an increased S % in the hardening agent to increase an initial strength from that of Test 6-1 to that equal to Test 6-4 leads enhanced final strength without shortened bench time of the binder. This means, as shown in Test 6-1 and Test 6-2, that use of the reclaimed molding sand used with the hardening agent (II) containing the organic sulfonic acid and small amounts of sulfuric acid and phosphoric acid can provide a method of producing a mold having good hardening behavior under high temperature conditions.

The invention claimed is:

1. A method for producing a mold comprising the steps of:

producing a mold with a spherical molding sand (A) having a sphericity of 0.95 or more, a binder (II) comprising an acid-hardening resin and a hardening agent (II), pouring metal into the obtained mold;

disintegrating and reclaiming the mold to obtain reclaimed molding sand;

mixing the reclaimed molding sand, a binder (I) comprising an acid-hardening resin and a hardening agent (I) to obtain kneaded sand; and forming the kneaded sand into a second mold, wherein the reclaimed molding sand comprises 60% by weight or more of $Al_2O_3$, and both of the hardening agents (I) and (II) comprise an organic sulfonic acid, and, in the hardening agents, a content of sulfuric acid is 2% by weight to 5% by weight and a content of phosphoric acid is not more than 5% by weight, wherein an ignition loss of the reclaimed molding sand is not more than 0.5% by weight; and an elution amount of elemental aluminum per 1 g of the reclaimed molding sand is not more than 50 μg in accordance with the following method of measurement:

25 g of the reclaimed molding sand is weighed in a beaker; to this is added 50 ml of 0.1 N—HCL aqueous solution, and stirred for 15 minutes; the mixture is allowed to stand for 5 minutes; a supernatant is filtered through a filtering paper; an elemental aluminum in the filtered supernatant is quantified by ICP analysis (Inductively Coupled Plasma Emission Spectrometry), and used to calculate an elution amount per 1 g of reclaimed molding sand.

2. The method for producing a mold according to claim 1, wherein the reclaimed molding sand is obtained from the obtained mold produced with a raw material composition for mold comprising the spherical molding sand (A) having a sphericity of 0.95 or more, the binder (II) comprising the acid-hardening resin and the hardening agent (II), and a contents of phosphoric acid in the raw material composition for mold is not more than 0.01 parts by weight to 100 parts by weight of the spherical molding sand (A).

3. The method for producing a mold according claim 1, wherein the reclaimed molding sand further comprises $SiO_2$.

4. The method for producing a mold according to claim 1, wherein the organic sulfonic acid is at least one acid selected from the group consisting of xylenesulfonic acid, toluenesulfonic acid, ethylbenzenesulfonic acid and methanesulfonic acid.

5. The method for producing a mold according to claim 1, wherein the binder (I) and/or the binder (II) further comprises an acid-hardening furan resin as the acid-hardening resin and a polyphenol compound.

6. The method for producing a mold according to claim 1, wherein the reclaimed molding sand further comprises $SiO_2$, and a weight ratio of $Al_2O_3/SiO_2$ is 1 to 15.

7. The method for producing a mold according to claim 1, wherein the hardening agent (II) has the content of phosphoric acid of substantially 0% by weight and the content of phosphoric acid in the hardening agent (I) is substantially 0% by weight.

8. The method for producing a mold according to claim 1, wherein the spherical molding sand (A) comprises $Al_2O_3$ and $SiO_2$ at a weight ratio of $Al_2O_3/SiO_2$ of 1.2 to 12.

9. The method for producing a mold according to claim 1, wherein an ignition loss of the reclaimed molding sand is zero (0) % by weight.

10. The method for producing a mold according to claim 1, wherein the organic sulfonic acid is a methanesulfonic acid.

11. The method for producing a mold according to claim 1, wherein the spherical molding sand is reclaimed by a roasting reclaiming treatment.

12. The method for producing a mold according claim 1, wherein the content of the sulfuric acid, which is derived from the hardening agent (II) and/or contained in the hardening agent (I), is from 2% by weight to 5% by weight.

13. The method for producing a mold according claim 12, wherein the content of the sulfuric acid contained in the hardening agent (I) is at least 2% by weight.

14. The method for producing a mold according claim 12, wherein the content of the sulfuric acid contained in the hardening agent (I) is at least 1% by weight.

15. The method for producing a mold according claim 12, wherein the hardening agent (II) contains at least 2% by weight of the sulfuric acid.

16. The method for producing a mold according claim 12, wherein the hardening agent (II) contains at least 1% by weight of the sulfuric acid.

* * * * *